United States Patent [19]

Tsubuko

[11] 4,181,620

[45] Jan. 1, 1980

[54] LIQUID DEVELOPER FOR USE IN ELECTROPHOTOGRAPHY

[75] Inventor: Kazuo Tsubuko, Tokyo, Japan

[73] Assignee: Ricoh Co., Ltd., Tokyo, Japan

[21] Appl. No.: 832,100

[22] Filed: Sep. 9, 1977

Related U.S. Application Data

[63] Continuation-in-part of Ser. No. 646,341, Jan. 2, 1976, abandoned.

[30] Foreign Application Priority Data

Jan. 7, 1975 [JP] Japan ..... 50/4556

[51] Int. Cl.[2] ..... G03G 9/12

[52] U.S. Cl. ..... 430/114; 430/137; 430/116

[58] Field of Search ..... 252/62.16; 96/124

[56] References Cited

U.S. PATENT DOCUMENTS

| | | | |
|---|---|---|---|
| 3,325,409 | 6/1967 | Whitbread | 252/62.1 L |
| 3,334,047 | 8/1967 | Matkan | 252/62.1 L |
| 3,701,731 | 10/1972 | Hencock et al. | 252/62.1 L |
| 3,793,234 | 2/1974 | Ormsbee | 252/62.1 L |
| 3,900,412 | 8/1975 | Kosel | 252/62.1 L |
| 3,976,583 | 8/1976 | Hermann et al. | 252/62.1 L |
| 3,991,226 | 11/1976 | Kosel | 252/62.1 L |
| 3,993,483 | 11/1976 | Maki et al. | 252/62.1 L |
| 4,060,493 | 11/1977 | Tsubuko et al. | 252/62.1 L |
| 4,061,582 | 12/1977 | Moschovis et al. | 252/62.1 L |

*Primary Examiner*—Roland E. Martin, Jr.

*Attorney, Agent, or Firm*—Blanchard, Flynn, Thiel, Boutell & Tanis

[57] ABSTRACT

A liquid developer for use in electrophotography, which is superior in storage stability and transferability, said developer comprising a resin A and a coloring agent dispersed in a carrier liquid having a high electric resistivity and a low dielectric constant, said coloring agent having a high electric resistivity and consisting essentially of fine particles of pigment coated with a resin B which is different from said resin A and is substantially insoluble in said carrier liquid.

23 Claims, No Drawings

LIQUID DEVELOPER FOR USE IN ELECTROPHOTOGRAPHY

CROSS REFERENCE TO RELATED APPLICATION

This application is a continuation-in-part of Ser. No. 646,341, filed Jan. 2, 1976, now abandoned.

BACKGROUND OF THE INVENTION

1. Field of the Invention

The present invention relates to a liquid developer for use in electrophotography which is superior in storage stability and particularly is superior in transferability.

2. Description of the Prior Art

The method of preparing electrophotographic toner particles by kneading a coloring agent consisting of pigment such as carbon black, Phthalocyanine Blue, Phthalocyanine Green, Sky Blue, etc. together with a resin and pulverizing the thus kneaded mixture is known. The method of preparing a liquid developer for use in electrophotography by kneading such coloring agents together with a resin, in the presence of a solvent, and dispersing the thus kneaded mixture in a carrier liquid, such as an aliphatic hydrocarbon, having a high insulating property (i.e., electric resistance of more than $10^9$ Ωcm) and a low dielectric constant (i.e., relative dielectric constant of less than 3) also is well known. However, the coloring agents thus employed have usually been untreated agents and accordingly those agents undergo intensive secondary agglomeration which renders it difficult to reduce them to primary particles even when there is used a conventional particle size reducing means such as a ball mill, attriter, ultrasonic disperser, etc. Consequently, in electrophotographic toner particles obtained by the known method as described above, the coloring agents are exposed on the surfaces of the toner particles, which causes lack of uniformity in the polarity controlling property of the particles. Further, when such toner particles contact an electrostatic latent image formed on an electrophotographic copying material, the electrical charge of the latent image is transmitted to the toner particles by way of the coloring agents exposed on the surface thereof, thereby making the polarity of the toner particles unstable. In addition, because the majority of the coloring agents are conductive and because they are exposed on the surfaces of the toner particles, it is difficult to electrostatically transfer the developed image (i.e., the toner image) formed on the copying material to a transfer paper. In this connection, the conventional electrostatic transfer method comprises the steps of squeezing the excess carrier liquid remaining on the copying material by corona discharge to some degree (because the mechanism of the electrostatic transfer method is mainly based on electrophoresis of toner particles in a carrier liquid although it also is partly based on the properties of the toner particles, and accordingly, an adequate amount of carrier liquid must be left in the toner image), superposing the copying material upon a transfer paper and then elecrically charging the transfer paper by corona discharge or the like, thereby to effect the transferring. However, this conventional transfer method is defective in that not only is it impossible to effect a high-speed copying because it takes a significant amount of time to transfer and to fix the toner image on the transfer paper completely, but also it emits an offensive smell and causes annoyance to persons in the surrounding area as a result of the evaporation of a large quantity of carrier liquid contained in the toner image during the transferring.

SUMMARY OF THE INVENTION

The present invention is intended to overcome the aforementioned drawbacks of the prior art. The present invention provides a liquid developer for use in electrophotography which developer is superior in storage stability and makes it unnecessary for the toner image to contain a large amount of carrier liquid at the time of transferring same, thereby reducing the amount of carrier liquid that needs to be evaporated and making it possible to effect the transfer and the fixation of the image rapidly. Accordingly, the present invention may be said to provide a developer which is effectively used especially in a process where a toner image is electrostatically transferred. The present invention provides a liquid developer for use in electrophotography comprising a resin A and a coloring agent dispersed in a carrier liquid having a high electric resistivity and a low dielectric constant, said coloring agent having a high electric resistivity and consisting essentially of fine particles of pigment coated with a resin B which is different from said resin A and is substantially insoluble in said carrier liquid.

The coloring agent used in the present invention, which consists essentially of fine particles of pigment coated with the B resin, has an average particle size ranging from 0.01 to 20 microns, preferably 0.1 to 1 micron, and the coloring agent has a high electric resistivity of about $10^8$ to $10^{14}$ Ωcm. The B resin is a resin which is substantially insoluble (totally insoluble or having a very low solubility) in the carrier liquid. The pigment used in the coloring agent of the present invention can include carbon black, various organic pigments and mixtures thereof. The carbon black pigment includes furnace black, acetylene black, channel black, etc. sold under the trademarks Printex G, Special Black 14, Special Black 4, Special Black 4-B (the foregoing are products of Degusa Inc.), Mitsubishi #44, Mitsubishi #33, MA-11, MA-100 (the foregoing are products of Mitsubishi Carbon K.K.), Rarven 30, Rarven 40 and Conductex SC (the foregoing are products of Cabot Inc.). Other suitable pigments include organic pigments such as Phthalocyanine Blue, Phthalocyanine Green, Sky Blue Lake, Rhodamine Lake, Malachite Green Lake, Methyl Violet Lake, Peacock Blue Lake, Naphthol Green B Lake, Naphthol Green Y Lake, Naphthol Yellow S Lake, Lithol Fast Yellow 2G, Permanent Red 4R, Brilliant Fast Scarlet Lake, Hansa Yellow, Benzidine Yellow, Lithod Red, Lake Red C, Lake Red D, Brilliant Carmine 6B Lake, Permanent Red F5R, Pigment Scarlet 3B and Bordeaux 10B.

As mentioned above, the present invention does not employ a dye but rather employs a pigment in the preparation of the coloring agent. This reason consists in that the pigment can exhibit superior properties such as the fading property and the dispersibility of coloring agent in the developer, and besides can obtain a high-concentrated image as compared with the dye. In the present invention, moreover, a coloring agent which is not coated by any resin may be added to the coloring agent which has been coated by the resin B. In this case it is still necessary to employ not a dye but a pigment.

Because the coloring agent of the present invention consists essentially of fine particles, there can be obtained an image of improved quality. Further, because the resin B is substantially insoluble in the carrier liquid, the coloring agent does not easily agglomerate, that is, it is superior in dispersibility, whereby the liquid developer possesses improved storage stability. Still further, because the coloring agent of the present invention possesses a high electric resistivity, its hygroscopicity is lower than conventional coloring agents for toners, which further improves the storage stability of the coloring agent per se. It is difficult to obtain a coloring agent all of whose particles are completely coated with the Resin B. However, when the coating is conducted so as to coat the pigment particles as completely as possible, the electrical resistivity of the coloring agent can be maintained at a high level. Therefore, the coloring agent employed in the present invention preferably is one coated to as complete an extent as possible. That is, the coloring agent is preferably in the state in which the pigment particles have been coated almost completely with the resin B. The words "almost completely" used herein to describe the amount of coating of the pigment particles by the B resin means that when the coloring agent particles are viewed under a microscope, it is observed that the major proportion of said pigment particles are not exposed and/or that even if the coating of the particles by the B resin is not complete, still only a small portion of the total surface areas of the pigment particles are exposed and the remainder thereof is coated by an adhering coating layer of the B resin, whereby the electric resistivity of the coloring agent, per se, is from $10^8$ to $10^{14}$ Ωcm.

As above-stated, the coloring agent of the present invention is in the state in which the pigment particles have been coated almost completely with the resin B. But, when the thus coated coloring agent is kneaded with other components in preparing the developer of the present invention, part of the coated layer of the resin B, on the occasion of kneading, sometimes falls off from the pigment particles. The so obtained coloring agent, even if part of the coated layer of the coloring agent falls off, still exhibits superior performances as compared with conventional coloring agents for use in liquid developers. Thus the developer of the present invention, which contains the aforementioned coloring agent particles, possesses characteristics which are not possessed by conventional developers. In particular our developer, into which it is difficult to inject the charge of the latent image, is so durable that a multiplicity of copies can be produced with little deterioration in the image density; the polarity of the developer remains unchanged even after repeated reproduction procedures; it exhibits an excellent transferability without requiring that a large quantity of the carrier liquid be contained in the image at the time of transferring; the thus-transferred image exhibits a superior fixability when dried; and so forth.

The process for preparing a coloring agent coated with the resin B according to the present invention can be any process which makes it possible to obtain a coloring agent having the aforementioned characteristics. As an example of such processes, there can be mentioned the so-called flushing process. This is a kind of kneading process which comprises thoroughly kneading a hydrated paste of pigment (water content: 40 to 90 wt.%) with a solvent solution of resin B thereby to replace the water surrounding said pigment by the resin solution, then removing therefrom the water and solvent to obtain a dry solid mass, and then crushing the mass to obtain finely divided dry particles of the desired coloring agent. In this case, the pigment contained in the hydrated paste can be carbon black, organic pigment or mixture thereof. Further, in the flushing process, mixtures of pigments may be coated with resin B in the following manners. For example, either a single hydrated pigment-containing paste can be kneaded with another pigment which is not in the form of a hydrated paste, or a hydrated pigment-containing paste can be kneaded with another hydrated pigment-containing paste. For example, 0.1 to 20 parts by weight of carbon black particles (not hydrated) can be kneaded with 1 part by weight of hydrated paste of an organic pigment.

The resin B for use in the coloring agent, comprises resins which are substantially insoluble in the aliphatic hydrocarbons which are employed as the carrier liquid for the liquid developers. Examples of suitable B resins are natural resin-modified phenol resin, natural resin-modified maleic resin, dammar, copal, shellac, gum rosin, hardened rosin, ester gum, glycerin estermodified maleic resin etc. The amount of the resin B employed is suitably in the range of from 0.5 to 5 parts by weight per 1 part by weight of the sum total of the pigment or pigments employed (water-free basis), preferably 1 to 4 parts of resin B per 1 part of pigment.

Further, it is possible additionally to add to the pigment, in addition to the B resin, a polymerizable monomer, together with a polymerization initiator, in an amount of $1\times10^{-3}$ to 0.1 part by weight per 1 part by weight of the sum total of the pigment or pigments employed (water-free basis). In this case, said monomer polymerizes during the kneading process, whereby the polarity of the toner particles is controlled also by the resulting polymer, as well as by the effect of the pigments.

The monomer employed for this purpose desirably is a monomer whose polymer exhibits a polarity controlling property on the coloring agent. As such monomers, there can be used unsaturated carboxylic acids such as acrylic acid, methacrylic acid, fumaric acid, itaconic acid, crotonic acid, maleic acid, etc., and vinyl monomers such as 2-hydroxyethyl acrylate, 2-hydroxyethyl methacrylate, 2-hydroxypropyl acrylate, 2-hydroxypropyl methacrylate, glycidyl acrylate, glycidyl methacrylate, styrene, chlorostyrene, vinyl acetate, acrylonitrile, methacrylonitrile, acrylamide, methacrylamide, N-vinyl pyrrolidone, etc.

The resin A component suitable for use in the present invention includes non-aqueous thermoplastic resins obtained by effecting graft-polymerization betwen a) a copolymer consisting of (i) a monomer having the following formula (1) and either (ii) glycidyl acrylate or glycidyl methacrylate or (iii) unsaturated carboxylic acid or unsaturated carboxylic acid anhydride, and b) a first grafting monomer which is an unsaturated carboxylic acid or anhydride thereof when said copolymer has been prepared using glycidyl acrylate or glycidyl methacrylate as a component thereof, or glycidyl acrylate or glycidyl methacrylate when said copolymer has been prepared using an unsaturated carboxylic acid or anhydride thereof as a component thereof, and then further grafting a second grafting monomer having the formula (2) or a monomer having the formula (3) onto the thus-grafted branch portion.

Formula (1):

-continued

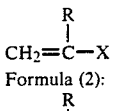

wherein R is H or $CH_3$:
X is $COOC_nH_{2n+1}$ or $OC_nH_{2n+1}$ ($6 \leqq n \leqq 20$).

Formula (2):

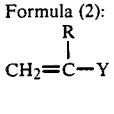

wherein R is H or $CH_3$;
Y is $-COOC_{n'}H_{2n'+1}$ ($\leqq n' \leqq 4$), $-OCOC_mH_{2m+1}$ ($1 \leqq m \leqq 6$),

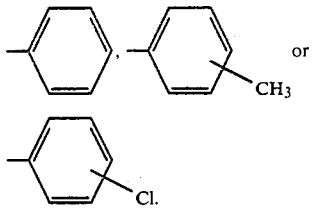

Formula (3):

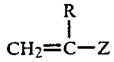

wherein R is H or $CH_3$;

Z is $-COOC_2H_4N(C_{n'}H_{2n'+1})_2$, $-COOH$, $-COOC_2H_4OH$, $-COOCH_2-CH(\diagdown O \diagdown)-CH_2$,

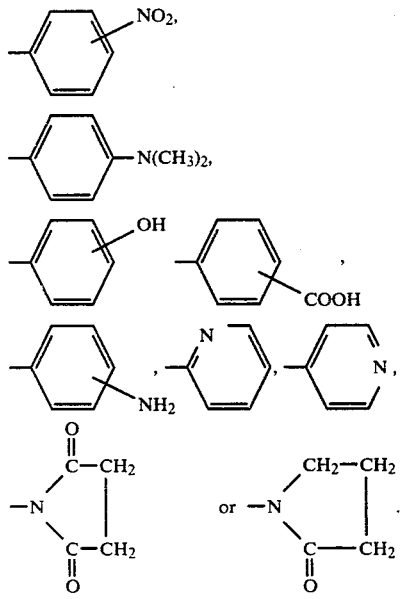

In the method of preparing these preferred resins A, in the first step, a mixture consisting of a monomer having the formula (1) with a comonomer selected from the group consisting of (i) glycidyl acrylate or glycidyl methacrylate, and (ii) unsaturated carboxylic acid or unsaturated carboxylic acid anhydride (mixing ratio for formula (1) monomer to comonomer by weight=99.9-80:0.1-20) is reacted by heating at a temperature in the range of from 70° to 150° C. within an aliphatic hydrocarbon solvent in the presence of azobisisobutyronitrile as an initiator.

To cite applicable monomers having the formula (1), there are higher alkyl esters (having 6 to 20 carbon atoms) such as lauryl, 2-ethylhexyl, stearyl, vinyl stearyl, etc. esters of acrylic acid or methacrylic acid. As the unsaturated carboxylic acids copolymerizable with these formula (1) monomers, there are acrylic acid, methacrylic acid, fumaric acid, crotonic acid, itaconic acid and maleic acid.

Next, the resulting reaction mixture is mixed with a first grafting monomer selected from the group consisting of (iii) glycidyl acrylate or glycidyl methacrylate when the above-mentioned comonomer was (ii) and (iiii) said unsaturated carboxylic acid or acid anhydride thereof when the above-mentioned comonomer was (i), wherein the amount of said first grafting monomer is from 0.1 to 20 parts by weight per 100 parts by weight of copolymer and is reacted by heating at a temperature in the range of from 30° to 120° C. in the presence of an esterification catalyst such as pyridine, lauryl dimethylamine, etc. As a result of this reaction, the copolymer is esterified and a graft active point is formed on the esterified portion (the thus-formed active point may be one per each polymer chain and therefore gellation does not readily take place). The esterified grafted copolymer constitutes the backbone portion of the graft copolymer obtained through the final step as described below, and it is obtained in the state of being dissolved in the aforementioned non-aqueous solvent.

Next, this reaction mixture is mixed with a second grafting monomer selected from the group consisting of the formula (2) monomer and the formula (3) monomer, in an amount of 5 to 100 parts by weight of said second grafting monomer per 100 parts by weight of the esterified copolymer and is reacted by heating at a temperature in the range of from 70° to 150° C. in the presence of a polymerization catalyst such as benzyl peroxide, azobisisobutyronitrile, etc. As a result of this reaction, there is obtained a copolymer consisting of said esterified copolymer as the backbone and the foregoing second grafting monomers grafted onto the esterified copolymer. The graft portion (second grafting monomer portion) is insoluble in the non-aqueous solvent. As the lower alkyl ester of acrylic acid (or methacrylic acid) included among said formula (2) monomers, alkyl esters having 1 to 4 carbon atoms, such as methyl, ethyl, propyl or butyl acrylate (or methacrylate), are employed.

Graft copolymers are obtained through the steps described above. In the present invention, it is also acceptable to incorporate in such graft copolymers waxy materials, such as paraffin wax, polyethylene having a softening point in the range of from 60° to 130° C. and the like, by adding said waxy material in any of the foregoing polymerization steps, dissolving it completely in the non-aqueous solvent by heating and finally cooling the reaction mixture after the final graft polymerization step.

As the non-aqueous solvent for use in the above-described polymerization process, there can be employed aliphatic hydrocarbons such as n-hexane, n-pentane, isooctane and commercially available Isopar H, G, L and K or halogenated derivatives thereof such as carbon tetrachloride and perchloroethylene. The non-aqueous solvent is heated at the time of the reaction as above described, but when the temperature of the non-aqueous solvent thus heated is still below the softening point of the wax or polyethylene, said wax or polyethylene may not dissolve completely. In that case, it is necessary to raise the temperature of the non-aqueous solvent so it is higher than the softening point of the waxy material by further heating the reaction mixture. Regardless of which process is chosen for the purpose of adding the wax-like material, such as paraffin wax, polyethylene having a softening point in the range of from 60° to 130° C. and the like, it has no affect on the polymerization reaction, and the quality of the non-aqueous thermoplastic resin finally obtained is not affected thereby.

Next, in the present invention, after completing the preparation of graft copolymer, the reaction mixture is cooled, whereby the wax or polyethylene, if dissolved therein, is precipitated in situ in the form of fine particles dispersed in the reaction mixture.

Further, a small amount of at least one kind of resin selected from other binder resins well known in this field for binding coloring agent particles, such as alkyd resin, cellulose derivatives, cyclized rubber, chlorinated rubber, styrene resin, styrene-butadiene copolymer, vinyl toluene-butadiene copolymer, acrylic resin, etc., can optionally be used jointly with the non-aqueous thermoplastic resin prepared as described above. The ratio of such additional resin to said non-aqueous thermoplastic resin is preferably in the range of 1:1 to 20 (parts by weight).

According to the present invention, the following resins can be used as the resin A component, in place of or in admixture with the above-described non-aqueous thermoplastic resin. The following resins are not useful as the resin B component used for making the coloring agent. The resins which can be used for this purpose are as follows; (A) styrene-butadiene copolymer (less than 30 mol % of butadiene), vinyl toluene-butadiene copolymer, vinyl toluene-2-ethylhexyl acrylate copolymer, vinyl toluene-lauryl methacrylate copolymer and vinyl toluene-octyl acrylate copolymer, such as the products sold under the trademark Pliolite S-5A, S-5B, S-5D, S-5E, KV, VT, VTAC, VTAC-L, AC and AC-L (these are products of Goodyear Tire & Rubber Co.), the products sold under the trademarks Piccolyte, Piccopear, Piccolastic D and Piccolastic E (these are products of ESSO Kasei K.K.), (B) polymers or copolymers consisting of a monomer or monomers having the following formulas (I) and/or (II):

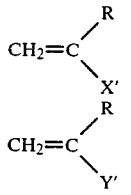

(I)

(II)

wherein R is H or $CH_3$, X' is

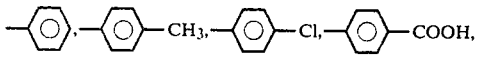

$-COOC_{n''}H_{2n''+1}$, $-OCOC_{n''}H_{2n''+1}$ or $-OC_{n''}H_{2n''+1}$ (n'' is an integer of 1 to 5) and Y' is $-COOC_{m''}H_{2m''+1}$, $-OCOC_{m''}H_{2m''+1}$ or $-OC_{m''}H_{2m''+1}$ (m'' is an integer of 4 to 17); and (C) isobutylene chlorinated isoprene copolymer, polybutylene, polyisobutylene, polyisoprene and styrene-butadiene copolymer (more than 40 mol % of butadiene), such as the products sold under the trademarks Solprene 1203, 303, 1204 and 1206 (these are products of Phillips Petroleum Co.), Petaprene H 100 (Reichhold Chemicals Inc.), Essobutyl HT-10-66, HT-10-67, HT-10-65, 035, 077, 150, 215, 217, 218 and 325, Essopistanex LM and MM, Essopistaron 3705, 4504 and 4605, Pico α-10 and Piccolastic A-75 (these are products of Esso Kasei Co.), Termolyte P, N and B (these are the products of Seiko Kagaku Co.).

The wax-like material, such as paraffin wax, polyethylene having a softening point in the range of from 60° to 130° C. and the like, as hereinbefore described, is readily available on the market. To give examples of commercial waxes and polyethylene, there are the following.

Examples of commercial polyethylene:

| Name of manufacturing company | Trademark | Softening point |
|---|---|---|
| Union Carbide Inc., U.S.A. | DYNI | 102° C. |
| | DYNE | 102 |
| | DYNH | 102 |
| | DYNJ | 102 |
| | DYNK | 102 |
| Du Pont Inc., U.S.A. | Alathon-3 | 103° C. |
| | Alathon-10 | 96 |
| | Alathon-12 | 84 |
| | Alathon-14 | 80 |
| | Alathon-16 | 95 |
| | Alathon-20 | 86 |
| | Alathon-22 | 84 |
| | Alathon-25 | 96 |
| Monsanto Inc., U.S.A. | Orizon 805 | 116° C. |
| | Orizon 705 | 116 |
| | Orizon 50 | 126 |
| Phillips Inc., U.S.A. | Marlex 1005 | 92° C. |
| Sanyo Kasei Kagaku K.K. | Sanwax 131P | 108° C. |
| | Sanwax 151P | 107 |
| | Sanwax 161P | 111 |
| | Sanwax 165P | 107 |
| | Sanwax 171P | 105 |
| | Sanwax E200 | 95 |
| Allied Chemical Co. | AC-Polyethylene 1702 | 98° C. |
| | AC-Polethylene 6&6A | 102 |
| | AC-Polyethylene 615 | 105 |
| Quaker State Oil Inc. | QS-Wax | 65° C. |

Example of commercial wax:

| Name of manufacturing company | Trademark | Softening point |
|---|---|---|
| Junsei Yakuhin K.K. | Parrafin Wax | 60–90° C. |

The toner in the present invention is prepared by employing a kneading-processed coloring agent as described above and a resin A as principal components thereof.

Hereunder will be give examples of preparation of the coloring agent for use in the present invention by applying the kneading process.

Example of Coloring Agent Preparation-1

| | |
|---|---|
| Water | 500 g |
| Carbon black MA-11 | 25 g |
| Phthalocyanine Blue (Water content: 70 wt. %) | 30 g |

After thoroughly stirring a mixture having the above composition by means of a kneader and then adding 700 g of 10% butanol solution of shellac thereto, the mixture was subjected to kneading at a temperature of 150° C. for 3 hours. Subsequently, after removing the residual water together with the solvent under reduced pressure by applying heat, the resulting solid was taken out of the kneader and was pulverized by means of a hammer mill.

Example of Coloring Agent Preparation-2

| | |
|---|---|
| Water | 500 g |
| Printex G | 30 g |
| Alkali Blue (Water content: 68 wt. %) | 20 g |

A mixture having the above composition was processed in the same way as described in Example of Coloring Agent Preparation-1 save for the employment of 600 g of 10% toluene solution of Beckasite P-720 (modified-maleic acid resin) in place of the 700 g of 10% butanol solution of shellac employed in preparation 1.

Example of Coloring Agent Preparation-3

| | |
|---|---|
| Water | 500 g |
| Rarven 30 | 40 g |
| Permanent Red | 20 g |

A mixture having the above composition was processed in the same way as described in Example of Coloring Agent Preparation-1 save for the employment of 15% xylene solution of dammar in place of the 10% butanol solution of shellac employed in preparation 1.

Example of Coloring Agent Preparation-4

| | |
|---|---|
| Water | 800 g |
| Conductex SC | 50 g |
| Brilliant Carmine 6B (Water content: 50 wt. %) | 50 g |

A mixture having the above composition was processed in the same way as described in Example of Coloring Agent Preparation-1 save for the employment of 10% xylene solution of Harimac M-135G (modified maleic acid resin) in place of the 10% butanol solution of shellac employed in preparation 1.

Example of Coloring Agent Preparation-5

| | |
|---|---|
| Water | 500 g |
| Carbon black MA-11 | 25 g |
| Phthalocyanine Blue | 30 g |

After thoroughly stirring a mixture having the above composition by means of a kneader and then adding 700 g of 10% butanol solution of shellac, 15 g of methacrylic acid and 0.1 g of azobisisobutylonitrile thereto, the mixture was subjected to kneading process at a temperature of 150° C. for 6 hours. The thus-obtained methacrylic acid polymer was present as a component of the resin B component coating the pigment.

Subsequently, after removing the residual water together with the solvent under reduced pressure by applying heat, the resulting solid was pulverized by means of a hammer mill.

Example of Coloring Agent Preparation-6.

Kneading process was performed in the same way as described in Example of Coloring Agent Preparation-5 save for the employment of 10 g of N-vinyl pyrrolidone in place of the methacrylic acid used therein.

Example of Preparation of Coloring Agent-7.

| | |
|---|---|
| Water | 500 g |
| Carbon black (MITSUBISHI MA-11) | 25 g |

A mixture having the above composition was thoroughly stirred by means of a kneader. Thereafter, 700 g of a 10% butanol solution of shellac was added thereto and kneaded at 150° C. for 3 hours. Then, the same was subjected to additional heating and vacuum drying to remove therefrom the butanol together with the remaining water. The solid product was taken out of the kneader and was crushed by means of a hammer mill, thereby obtaining a coloring agent.

Example of Preparation of Coloring Agent-8

| | |
|---|---|
| Water | 500 g |
| Phthalocyanine Blue (Water content: 70 wt. %) | 30 g |

The above composition was subjected to the same procedure as that described in Example of Preparation of Coloring Agent-7 to prepare a coloring agent.

Example of Preparation of Coloring Agent-9

Twenty-five g of carbon black identical with that used in Example of Preparation of Coloring Agent-7 and 700 g of a 10% butanol solution of shellac were charged in a kneader and kneaded at 150° C. for 3 hours. Then, the same was subjected to additional heating and vacuum drying to remove therefrom the remaining water. The solid product was taken out of the kneader and was crushed by means of a hammer mill, thereby obtaining a coloring agent.

Next, in the following will be given examples of the preparation of the non-aqueous thermoplastic resin for use as the resin A in the toner according to the present invention.

Example of Resin A Preparation-1

300 g of Isopar H (a product of Esso Standard Oil Inc.) were placed in a receptacle equipped with a stirrer, thermometer and reflux condenser and were heated at a temperature of about 90° C. Then, there was added a mixture solution consisting of 190 g of lauryl methacrylate, 10 g of glycidyl methacrylate and 2 g of benzoyl peroxide dropwise over 2 hours' period and the mixture was stirred for 1 hour subsequent thereto. Then there were added 1 g of lauryl dimethylamine, 5 g of acrylic acid and 0.1 g of hydroquinone, and reaction was effected at a temperature of 90° C. for 15 hours. Subsequently, 300 g of Isopar H was added to the resulting reacting product and then there was added a solution consisting of 50 g of methyl methacrylate, 5 g of p-aminostyrene and 2 g of azobisisobutyronitrile dropwise at a temperature of 90° C. over 1 hour's period and after further stirring for 1 hour, there was obtained a white-colored, dispersed polymerized product. This product was a stable latex comprising 28 wt.% of solid matter.

Examples of Resin A Preparation-2

300 g of Isopar G(a product of Esso Standard Oil Inc.) were placed in a receptacle equipped with a stirrer, thermometer and reflux condenser and were heated at a temperature of 95° C. There was added a mixture consisting of 200 g of 2-ethylhexyl methacrylate, 10 g of glycidyl methacrylate and 3 g of azobisisobutyronitrile dropwise at a constant velocity over 3 hours' period, and then the contents of the receptacle were further stirred for 1 hour thereby to complete the reaction. Subsequently, there were added 5 g of acrylic acid, 0.1 g of hydroquinone and 1 g of lauryl dimethylamine and reaction was effected at a temperature of 90° C. for 15 hours, whereby the copolymer obtained through the foregoing reaction was esterified. The degree of esterification, as measured on the basis of the decrease in acid value, was in the range of from 25 to 30%. Next, after adding 500 g of Isopar G to the thus-esterified reaction mixture, 50 g of methyl methacrylate and 3 g of azobisisobutyronitrile were added thereto dropwise at a constant velocity over 3 hours' period at a temperature of 90° C. and the temperature of the reaction mixture was further maintained at said temperature for about 5 hours in order to complete the reaction. Then, after adding 300 g of Isopar G to 300 g of the reaction product and heating at a temperature of 90° C. subsequent thereto, 50 g of polyethylene (i.e., Orizon 805, the manufacture of Monsanto Chemical Inc.) were added thereto and were heated for 1 hour so as to make it transparent and dissolve it in the reaction mixture. The resulting resin solution was cooled with service water while stirring. The thus-obtained product was a lactescent latex comprising 17.4 wt.% of solid matter and having a particle size of 0.3 to 0.5μ.

Example of Resin A Preparation-3

300 g of Isopar H were placed in a receptacle equipped with a stirrer, thermometer and reflux condenser and were heated at a temperature of 95° C. Then, there was added to a mixture consisting of 200 g of 2-ethylhexyl methacrylate, 80 g of glycidyl methacrylate and 3 g of azobisisobutyronitrile dropwise at a constant velocity over 3 hours' period, and then the contents of the receptacle were further stirred for about 1 hour thereby to complete the reaction. Subsequently, there were added 15 g of methacrylic acid, 0.1 g of hydroquinone and 1 g of lauryl dimethylamine and reaction was effected at a temperature of 90° C. for 15 hours, whereby the copolymer obtained through the foregoing reaction was esterified. The degree of esterification, as measured on the basis of the decrease in acid value, was in the range of from 25 to 30%. Next, 500 g of Isopar H were added to the thus-esterified reaction mixture, 50 g of methyl methacrylate together with 3 g of azobisisobutyronitrile were added thereto dropwise at a constant velocity over 3 hours' period at a temperature of 90° C. and the reaction mixture was further maintained at said temperature of 90° C. for 5 hours. Then, after adding 300 g of Isopar H to 300 g of the reaction product and heating at a temperature of 90° C. subsequent thereto, 50 g of paraffin wax (softening point: 78° C.) were added thereto and were heated for 1 hour so as to make it transparent and dissolve it in the reaction mixture. The resulting resin solution was cooled with service water while stirring, whereby a latex was obtained.

Example of Resin A Preparation-4

By applying the same procedure as described in Example of Resin A Preparation-3 save for the employment of lauryl methacrylate in place of 2-ethylhexyl methacrylate, a latex was prepared.

Example of Resin A Preparation-5

By applying the same procedure as described in Example of Resin A Preparation-3 save for the employment of lauryl methacrylate in place of 2-ethylhexyl methacrylate and the employment of Orizon 705 (softening point: 106° C.) in place of paraffin wax, a latex was prepared.

Example of Resin A Preparation-6

400 g of issoctane were placed in the same receptacle as that employed in Example of Resin A Preparation-3 and were heated at a temperature of 95° C. Then, there was added a mixture consisting of 200 g of lauryl methacrylate, 40 g of glycidyl acrylate and 2 g of benzoyl peroxide (BPO) dropwise, and polymerization was effected for 3 hours at a temperature of 90° C. Subsequently, there were added 1 g of lauryl dimethylamine, 8 g of methacrylic acid and 0.1 g of hydroquinone to the reaction mixture, and an esterification reaction was effected for 1 hour at a temperature of 95° C. Next, while maintaining the temperature of the reaction mixture at 95° C. and after adding 600 g of issoctone thereto, a mixture solution consisting of 60 g of styrene and 4 g of BPO was added thereto dropwise and grafting reaction was effected for 5 hours. Then, 200 g of isooctane and 55 g of paraffin wax (softening point: 70°–72° C.) were added to the resulting reaction product at a temperature of 90° C. and dissolved therein. Next, by adding 5 g of N-vinyl pyrrolidone together with 1 g of benzoyl peroxide, effecting polymerization for 3 hours at a temperature of 90° C., and then cooling the reaction mixture with service water while stirring, a latex was prepared.

Example of Resin A Preparation-7

By applying the same procedure as described in Example of Resin A Preparation-6 save for the employment of chlorostyrene in place of styrene, a latex was prepared.

Example of Resin A Preparation-8

By applying the same procedure as described in Example of Resin A Preparation-6 save for the exclusion of paraffin wax, a latex was prepared.

Example of Resin A Preparation-9

By applying the same procedure as described in Example of Resin A Preparation-6 save for the employment of methyl methacrylate in place of styrene and the employment of Sanwax 131-P in place of paraffin wax, a latex was prepared.

PREFERRED EMBODIMENTS OF THE INVENTION

EXAMPLE 1

| | |
|---|---|
| coloring agent obtained in Example of Preparation of coloring agent-2 | 5 g |
| resin latex obtained in Example of Preparation of A resin-2 | 50 g |
| Isopar G (the product of Esso Standard Oil Inc.) | 100 g |

A mixture having the above composition was dispersed for 40 hours by means of a ball mill, whereby a concentrated toner was prepared. Subsequently, by dispersing 10 g of the thus-prepared concentrated toner in 2 l of Isopar G, a liquid developer was prepared. Meanwhile, an electrostatic latent image was formed on a commercial electrohotographic copying paper (zinc oxide-resin dispersion type copying paper) through the conventional process. When this latent image was developed with the foregoing developer, there was obtained a copy having the concentration of image of 1.3 and improved fixability compared with the copies produced by means of conventional developers. Besides, when a forced deterioration test was conducted at a temperature of 50° C. over 7 days' period to examine the stability of the toner, there was observed little change from the state of the toner prior to the test.

EXAMPLE 2

| | |
|---|---|
| coloring agent obtained in Example of Preparation of coloring agent-1 | 10 g |
| resin latex obtained in Example of Preparation of A resin-1 | 100 g |
| Zinc naphthenate (10% Isopar H solution) | 0.01 g |
| Isopar G | 100 g |

A mixture having the above composition was dispersed for about 40 hours by means of a ball mill, whereby a concentrated toner was prepared. Subsequently, by dispersing 10 g of the thus-prepared concentrated toner in 2 l of Isopar G, a liquid developer was prepared. Next, an electrostatic latent image was formed on a commercial electrophotographic copying paper through the conventional process and thereafter developed with the foregoing developer, whereby there was obtained a copy with the same quality as that obtained in Example 1. Further, when this copy was desensitized and employed for printing as an offset master, a clear-cut finish was obtained. Especially, because the oleophilic property of the toner was superior, the ink spread well on the image area of the offset master and the final concentration of the printed image area was more than 1.5. Also, because the fixability of the toner onto the offset master was superior, it was possible to produce as many as 30,000 prints. The stability of the present developer was satisfactory like that in Example 1.

EXAMPLE 3

| | |
|---|---|
| coloring agent obtained in Example of Preparation of coloring agent-2 | 10 g |
| resin latex obtained in Example of Preparation of A resin-1 | 50 g |
| Styrene-butadiene copolymer | 15 g |
| Isopar G | 120 g |

A mixture having the above composition was kneaded for 72 hours by means of a ball mill and 5 g of the resulting concentrated toner were dispersed in 2 l of Isopar G, whereby a liquid developer for the in electrophotography was prepared.

A developed image produced by this developer was superior in fixability, and the dispersion stability of the developer also proved superior.

EXAMPLE 4

| | |
|---|---|
| coloring agent obtained in Example of Preparation of coloring agent-2 | 8 g |
| resin latex obtained in Example of Preparation of A resin-3 | 90 g |
| Isopar H | 100 g |

A mixture having the above composition was dispersed for 28 hours by means of a ball mill and 2 g of the resulting concentrated toner were dispersed in 2 l of Isopar H, whereby a liquid developer was prepared. When an electrostatic latent image was developed with this developer by means of a commercial electrophotographic copying machine and transfer was conducted by superposing a transfer paper on the thus developed image and charging, there was obtained a copy having an image with the concentration of 1.22 and fixability percentage of 82%. The fixability percentages (of toner which has been transferred to transfer paper) is calculated by the equation: (density of toner remaining on transfer paper after 5 reciprocations of an eraser thereacross)×100/(initial density of toner on transfer paper). This copy showed no change in the quality of the image from the initial state even after 1 month's storage at a temperature of 50° C.

EXAMPLE 5

| | | |
|---|---|---|
| coloring agent obtained in Example of Preparation of coloring agent-1 | | 10 g |
| resin latex obtained in Example of Preparation of A resin-4 | 100 g | 150 g |
| resin latex obtained in Example of Preparation of A resin-8 | 50 g | |
| Isopar H | | 105 g |

A mixture having the above composition was dispersed for 12 hours by means of an attriter and 10 g of the resulting concentrated toner were dispersed in 2 l of Isopar H, whereby a liquid developer for use in electrophotography was prepared. When the developer was employed in copying by means of a commercial electrophotographic copying machine, there was reproduced an image having the concentration of 1.18, resolving power of 9 lines/mm, and a grade of 9, as measured by the 12 grade Kodak Gray Scale. Besides, the fixability of said image proved satisfactory.

EXAMPLE 6

| | |
|---|---|
| coloring agent obtained in Example of Preparation of coloring agent-4 | 50 g |
| resin latex obtained in Example of Preparation of A resin-5 | 140 g |
| Carbon MA-11 | 10 g |
| Methylene Blue FZ | 1 g |
| Isopar G | 240 g |

A mixture having the above composition was dispersed for 4 hours by means of an attriter and 30 g of the resulting concentrated toner were dispersed in 3 l of Isopar G, whereby liquid developer for use in electrophotography was prepared. When this developer was employed in developing by means of a commercial electrophotographic copying machine, there was obtained a copy carrying an image having the concentration of 1.20, resolving power of 8 lines/mm, and a grade of 9. Besides, this copy showed no change in the quality of the image from the initial state even after 3 months' storage in the liquid developer at a temperature of 50° C.

EXAMPLE 7

| | |
|---|---|
| Solpren 1205 (Styrene-Butadiene type resin) | 10 g |
| coloring agent obtained in Example of Preparation of coloring agent-5 | 80 g |
| resin latex obtained in Example of Preparation of A resin-6 | 200 g |
| Red 616 | 1 g |
| Isopar G | 400 g |

A mixture having the above composition was first dispersed for 40 hours by means of a ball mill and further dispersed for 4 hours by means of an attriter, whereby a concentrated toner was prepared. Subsequently, by dispersing 10 g of the thus prepared concentrated toner in 3 l of Isopar G, a liquid developer for use in electrophotography was prepared. When an image was formed on a commercial electrophotographic offset master paper by employing this liquid developer, desensitized and employed for offset printing thereafter, it was possible to produce as many as 30,000 prints, and the concentration of image was 1.40.

EXAMPLE 8

| | | |
|---|---|---|
| coloring agent obtained in Example of Preparation of coloring agent-6 | | 20 g |
| resin latex obtained in Example of Preparation of A resin-9 | 100 g | 150 g |
| resin latex obtained in Example of Preparation of A resin-7 | 50 g | |
| Carbon Mitsubishi #44 | | 8 g |
| Isopar H | | 400 g |

A mixture having the above composition was dispersed for 11 hours by means of an attriter and 40 g of the resulting concentrated toner were dispersed in 2 l of Isopar H, whereby a liquid developer for use in electrophotography was prepared. When this developer was employed in copying by means of a commercial electrophotographic copying machine, there was obtained an image having the concentration of 1.16 and resolving power of 9 lines/mm. When this copy was employed in offset printing, there was obtained as many as 30,000 prints (this fact shows the superiority of the toner fixability on the transfer paper).

EXAMPLE 9

| | |
|---|---|
| coloring agent obtained in Example of Preparation of coloring agent-7 | 5 g |
| resin obtained in Example of Preparation of A resin-2 | 50 g |
| Isopar G | 100 g |

A mixture having the above composition was subjected to the same procedure as that described in Example 1 to prepare a liquid developer for use in electrophotography. Repeating the procedure of Example 1, there was obtained a copy having an image with the concentration of 1.25. This copy was superior in fixability as compared with conventional ones, and it was possible to produce as many as 30,000 prints.

EXAMPLE 10

| | |
|---|---|
| coloring agent obtained in Example of Preparation of coloring agent-8 | 5 g |
| resin obtained in Example of Preparation of A resin-2 | 50 g |
| Isopar G | 100 g |

A mixture having the above composition was subjected to the same procedure as that described in Example 1 to prepare a liquid developer for use in electrophotography. Repeating the procedure of Example 1, there was obtained a copy having an image with the concentration of 1.33 and transferability of 78%. The developer was stable even after 7 days' storage at 50° C.

The embodiments of the invention in which an exclusive property or privilege is claimed are defined as follows:

1. A liquid developer for use in electrophotography comprising coloring agent particles and an A resin dispersed in a carrier liquid having a high electric resistivity and a low dielectric constant, said coloring agent particles having an average particle size in the range of from 0.01 to 20 microns and having an electric resistivity of about $10^8$ to $10^{14}$ Ωcm, said coloring agent particles consisting essentially of fine pigment particles substantially completely coated with B resin which is substantially insoluble in said carrier liquid, said coloring agent particles having been prepared by kneading an aqueous paste of pigment with an organic solvent solution of said B resin to displace the water from the pigment and to replace it by said solution of said B resin, followed by removing water and said solvent and then pulverizing the resulting dry solids, said A resin being a non-aqueous thermoplastic resin prepared by effecting graft polymerization between (a) a copolymer of (i) monomer having the formula $$CH_2{=}\overset{\overset{\displaystyle R}{|}}{C}{-}X$$

wherein R is H or $CH_3$, and X is $COOC_nH_{2n+1}$ or $OC_nH_{2n+1}$ and $6 \leqq n \leqq 20$, and (ii) glycidyl acrylate or glycidyl methacrylate, or (iii) unsaturated carboxylic acid or unsaturated carboxylic acid anhydride, and (b) a first grafting monomer which is an unsaturated carboxylic acid or unsaturated carboxylic acid anhydride when said copolymer has been prepared using glycidyl acrylate or glycidyl methacrylate, or which is glycidyl acrylate or glycidyl methacrylate when said copolymer has been prepared using said unsaturated carboxylic acid or unsaturated carboxylic acid anhydride, and then further grafting a second grafting monomer selected from the group consisting of $$CH_2{=}\overset{\overset{\displaystyle R}{|}}{C}{-}Y$$

wherein R has the same meaning as defined above, and Y is $$-COOC_{n'}H_{2n'+1} \text{ and } 1 \leqq n' \leqq 4$$

-continued $-OCOC_mH_{2m+1}$ and $1 \leqq m \leqq 6$

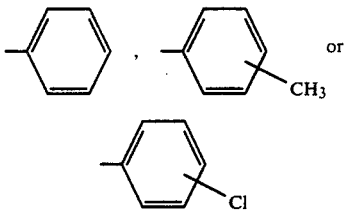

and

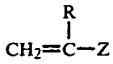

wherein R has the same meaning as defined above, and Z is $-COOC_2H_4N(C_{n'}H_{2n'+1})_2$,
$-COOH$, $-COOC_2H_4OH$,
$-COOCH_2-CH-CH_2$,

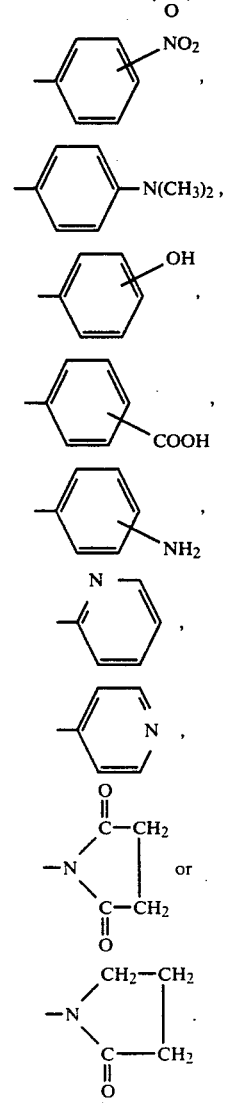

2. A liquid developer according to claim 1 in which the amount of said B resin is from 0.5 to 5 parts by weight, per 1 part by weight of pigment.

3. A liquid developer according to claim 1, wherein said pigment is carbon black.

4. A liquid developer according to claim 1, wherein said pigment is an organic pigment or mixture of organic pigments.

5. A liquid developer according to claim 1, wherein said pigment is a mixture of organic pigment with carbon black.

6. A liquid developer according to claim 1, wherein said resin B is a member selected from the group consisting of natural resin-modified phenol resin, natural resin-modified maleic resin, dammar, copal, shellac, gum rosin, hardened rosin, ester gum, glycerin-modified maleic resin, and mixtures thereof.

7. A liquid developer according to claim 1, wherein said coloring agent additionally contains a polarity controlling polymer having a monomer unit selected from the group consisting of unsaturated carboxylic acid and vinyl monomer, said polymer having been prepared by incorporating from $1 \times 10^{-3}$ to 0.1 part by weight of said monomer, per 1 part by weight of said pigment, and a polymerization initiator in the mixture of pigment particles and B resin in the kneading step so that said monomer polymerizes during the kneading step.

8. A liquid developer according to claim 7, wherein said unsaturated carboxylic acid is selected from the group consisting of acrylic acid, methacrylic acid, fumaric acid, itaconic acid, crotonic acid and maleic acid, and said vinyl monomer is selected from the group consisting of 2-hydroxyethyl acrylate, 2-hydroxyethyl methacrylate, 2-hydroxypropyl acrylate, 2-hydroxypropyl methacrylate, styrene, chlorostyrene, vinyl acetate, acrylonitrile, glycidyl acrylate, glycidyl methacrylate, acrylamide, methacrylamide and N-vinyl pyrrolidone.

9. A liquid developer according to claim 1, wherein said nonaqueous thermoplastic resin is prepared by adding and dissolving wax-like material in any one of the manufacturing steps thereof and cooling after performing the final step.

10. A liquid developer according to claim 9, wherein the wax-like material is at least one substance selected from the group consisting of paraffin wax and polyethylene having a softening point in the range of from 60° to 130° C.

11. A liquid developer according to claim 1, wherein at least one member selected from the group consisting of acrylic resin, styrene resin, alkyd resin, cyclized rubber, chlorinated rubber, cellulose derivative, styrene-butadiene copolymer and vinyl-toluene-butadiene copolymer is added to said non-aqueous thermoplastic resin.

12. A liquid developer according to claim 11, wherein the ratio of said member to said non-aqueous thermoplastic resin is in the range of 1:1 to 20% by weight.

13. A liquid developer according to claim 1 in which said carrier liquid is an aliphatic hydrocarbon having an electric resistivity of more than $10^9$ Ω.cm and a dielectric constant of less than 3.

14. A liquid developer according to claim 13 wherein said A resin component is a non-aqueous thermoplastic resin latex prepared by carrying out successively the following three steps (a), (b) and (c) in an aliphatic hydrocarbon or halogenated aliphatic hydrocarbon solvent (a) copolymerizing from 99.9 to 80 parts by weight of a monomer having the formula

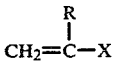

wherein R is as defined above and X is $-COOC_nH_{2n+1}$ or $-OC_nH_{2n+1}$ wherein n is from 6 to 20, with from 0.1 to 20 parts by weight of a co-monomer selected from the group consisting of an unsaturated carboxylic acid, glycidyl acrylate and glycidyl methacrylate (b) esterifying 100 parts by weight of the copolymer obtained in step (a) with from 0.1 to 20 parts by weight of glycidyl acrylate or glycidyl methacrylate when said copolymer has been prepared by using an unsaturated carboxylic acid, or esterifying 100 parts by weight of the copolymer obtained in step (a) with from 0.1 to 20 parts by weight of said unsaturated carboxylic acid when said copolymer has been prepared by using glycidyl acrylate or glycidyl methacrylate; and (c) grafting 100 parts by weight of the esterified copolymer obtained in step (b) with from 5 to 100 parts by weight of at least one monomer selected from the group consisting of a monomer having the formula

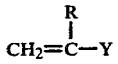

wherein R is as defined above and Y is $-COOC_{n'}H_{2n'+1}$ wherein n' is 1 to 4, $-OCOC_mH_{2m+1}$ wherein m is 1 to 6,

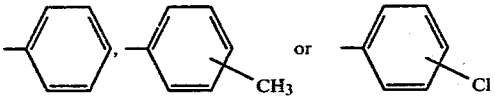

and monomer having the formula

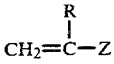

wherein R is as defined above and Z is $-COOC_2H_4N(C_{n'}H_{2n'+1})_2$ wherein n' is as defined above, —COOH, $-COOC_2H_4OH$,

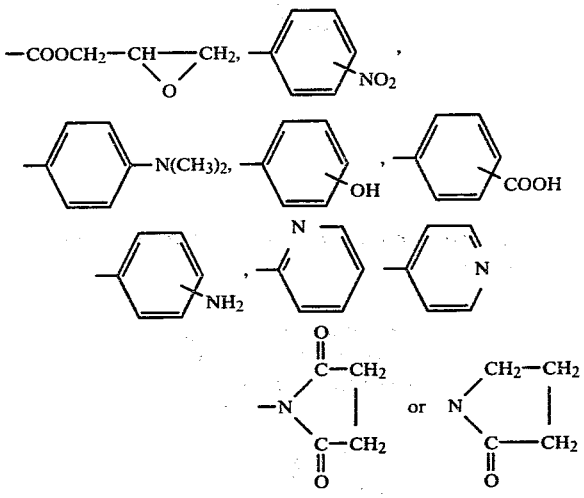

15. A liquid developer according to claim 1 wherein said B resin is natural resin-modified phenol resin.

16. A liquid developer according to claim 1 wherein said B resin is natural resin-modified maleic resin.

17. A liquid developer according to claim 1 wherein said B resin is dammar.

18. A liquid developer according to claim 1 wherein said B resin is copal.

19. A liquid developer according to claim 1 wherein said B resin is shellac.

20. A liquid developer according to claim 1 wherein said B resin is gum rosin.

21. A liquid developer according to claim 1 wherein said B resin is hardened rosin.

22. A liquid developer according to claim 1 wherein said B resin is ester gum.

23. A liquid developer according to claim 1 wherein said B resin is glycerin-modified maleic resin.

* * * * *